US012702185B2

(12) United States Patent
Lyon

(10) Patent No.: US 12,702,185 B2
(45) Date of Patent: Aug. 11, 2026

(54) SYSTEMS AND METHODS FOR FLEXIBLE FOOTWEAR

(71) Applicant: PEDESTAL FOOTWEAR, Boston, MA (US)

(72) Inventor: Michael Lyon, Revere, MA (US)

(73) Assignee: PEDESTAL FOOTWEAR, Boston, MA (US)

( * ) Notice: Subject to any disclaimer, the term of this patent is extended or adjusted under 35 U.S.C. 154(b) by 0 days.

(21) Appl. No.: 18/318,405

(22) Filed: May 16, 2023

(65) Prior Publication Data

US 2023/0363485 A1 Nov. 16, 2023

Related U.S. Application Data

(60) Provisional application No. 63/342,435, filed on May 16, 2022.

(51) Int. Cl.

| | |
|---|---|
| ***A43B 1/10*** | (2006.01) |
| ***A41B 11/00*** | (2006.01) |
| ***A41D 31/10*** | (2019.01) |
| ***A41D 31/18*** | (2019.01) |
| ***A41H 43/00*** | (2006.01) |

(52) U.S. Cl.

CPC ..... *A43B 1/10* (2013.01); *A41B 11/007* (2013.01); *A41D 31/10* (2019.02); *A41D 31/18* (2019.02); *A41H 43/00* (2013.01); *A41D 2500/10* (2013.01); *A41D 2500/54* (2013.01)

(58) Field of Classification Search

USPC ..... 36/102

See application file for complete search history.

(56) References Cited

U.S. PATENT DOCUMENTS

| | | | | | |
|---|---|---|---|---|---|
| 2,617,208 | A * | 11/1952 | Marx | A43B 3/02 | 12/142 EV |
| 2,789,933 | A * | 4/1957 | Bargmeyer | B29D 35/06 | 12/142 EV |
| 4,092,279 | A * | 5/1978 | Piskoti | B29C 37/0075 | 428/494 |
| 4,103,439 | A * | 8/1978 | Abramson | A43B 1/10 | 36/7.3 |
| 4,188,680 | A * | 2/1980 | Adams | B29C 41/14 | 12/142 E |
| 5,926,888 | A * | 7/1999 | Chen | B29C 41/14 | 12/142 EV |
| 2003/0154625 | A1* | 8/2003 | Royle | A41B 11/00 | 36/7.3 |
| 2006/0183849 | A1* | 8/2006 | Liu | C08G 18/0895 | 524/589 |

(Continued)

*Primary Examiner* — Matthew R Marchewka

(74) *Attorney, Agent, or Firm* — Peter A. Sullivan; Stephen J. Kenny; Foley Hoag LLP

(57) ABSTRACT

A footwear article, the footwear article including a sock having a proximal end and a distal end, the proximal end having an opening configured to receive a human foot and the distal end terminating in a curved closed cavity configured to receive a toe portion of the human foot, the distal end and the proximal ended defining an tubular body therebetween, the tubular body having a curved heel portion proximate the opening of the distal end, the heel portion extending to the toe portion forming a sole portion on an underside of the sock and a rubber layer disposed on at least a portion of the underside of the sock.

10 Claims, 8 Drawing Sheets

(56) References Cited

U.S. PATENT DOCUMENTS

| | | | | |
|---|---|---|---|---|
| 2012/0000094 | A1* | 1/2012 | Fliri | A43B 13/145 36/94 |
| 2016/0128433 | A1* | 5/2016 | Downing | A43D 95/14 264/400 |
| 2016/0262469 | A1* | 9/2016 | Fernando | D04B 1/28 |
| 2018/0098587 | A1* | 4/2018 | Moore | A43B 23/0205 |
| 2018/0242694 | A1* | 8/2018 | Webster | B32B 5/024 |
| 2022/0175068 | A1* | 6/2022 | Modha | C09D 5/024 |

* cited by examiner

SYSTEMS AND METHODS FOR FLEXIBLE FOOTWEAR

CROSS-REFERENCE TO RELATED APPLICATIONS

This application claims the benefit of priority to U.S. Provisional Patent App. No. 63/342,435, titled "SYSTEMS AND METHODS FOR FLEXIBLE FOOTWEAR," filed on May 16, 2022, the entire contents of which are hereby incorporated by reference herein.

BACKGROUND OF THE DISCLOSED SUBJECT MATTER

Field of the Disclosed Subject Matter

The disclosed subject matter relates to a system and method for performance footwear. Particularly, the present disclosed subject matter is directed to systems and methods for flexible footwear for proprioception, specifically a process for applying a rubber surface to a sock to allow for waterproof sole that is also pliable and stretchable on the foot.

Description of Related Art

A variety of methods, systems, and/or products are directed to athletic footwear. Athletic footwear ranges in functionality from lightweight, flexion, specific-use (like cleats), balance, and the like. People who engage in weight-lifting, fitness and associated activities often prefer not to use any footwear at all because they want engagement with the floor surface. This connection is called proprioception, which is a body's awareness of where it is in space. Walking barefoot in gyms has its own drawbacks, including the hygiene issues surrounding walking barefoot. Shoes designed for low more natural foot flexibility and balance are constraining to an athlete or person engaging in athletic activities in other ways such as a thick rubber sole and floor feel such as those designed for individual toe flexibility.

The options available to obtain this engagement include using lightweight socks, which allow for more floor feel than wearing shoes. Using socks is an improvement over using bare feet, but one drawback is the increased potential for slipping. The sock is also more susceptible to picking up floor moisture.

SUMMARY OF THE DISCLOSED SUBJECT MATTER

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a footwear article, the footwear article including a sock having a proximal end and a distal end, the proximal end having an opening configured to receive a human foot and the distal end terminating in a curved closed cavity configured to receive a toe portion of the human foot, the distal end and the proximal ended defining an tubular body therebetween, the tubular body having a curved heel portion proximate the opening of the distal end, the heel portion extending to the toe portion forming a sole portion on an underside of the sock; and a rubber layer disposed on the underside of the sock, the rubber layer disposed on at least a portion of the heel portion, the sole portion and the toe portion, the rubber layer having at least a bubble formed therein.

In various embodiments, the rubber layer is disposed on the underside of the sock, extending from the heel portion through the sole portion to the toe portion.

In various embodiments, the rubber layer extends radially upward from the underside of the sock to a lateral edge of the sock.

In various embodiments, the sock comprises a leg portion continuously connected to the tubular body, the leg portion extending a distance opposite the toe portion, the leg portion having an opening configured to accept the human foot therethrough.

In various embodiments, the leg portion comprises one of a mid-calf leg length, a low-cut length or a mid-ankle length.

In various embodiments, at least a portion of the sock is formed from a plurality of fibers in a knit construction.

In various embodiments, at least a portion of the sock comprises an elastic component, configured to allow the at least one of the heel portion or the toe portion to stretch in a transverse or longitudinal direction relative to the elongate body.

In various embodiments, at least one of the heel portion, sole portion or toe portion comprise a reinforcement section, wherein the reinforcement section.

In various embodiments, the sock comprises at least a second rubber layer disposed on the underside of the sock.

Additionally, to achieve these and other advantages and in accordance with the purpose of the disclosed subject matter, as embodied and broadly described, the disclosed subject matter includes a method for forming a footwear article, the method including immersing at least a portion of a sock into a coagulant, stretching the coagulant-immersed sock over a form, the form having the shape of at least a portion of a human foot, immersing at least a portion of the sock into a rubber solution, immersing at least a portion of the sock into a leaching solution, wherein the leaching solution removes water-based chemicals form the sock and drying at least a portion of the sock, wherein drying the sock activates a hardening process of the rubber solution.

In various embodiments, the method further includes washing the sock with the rubber layer disposed thereon and further drying the sock.

In various embodiments, the portion of the sock immersed in the coagulant is an underside of the sock, the underside of the sock having a heel portion, a sole portion and a toe portion.

In various embodiments, the coagulant is comprises at least a salt, at least a surfactant, at least a thickening agent, and at least a release agent in a water-based solvent.

In various embodiments, the at least a salt is calcium nitrate.

In various embodiments, immersing at least a portion of the sock in the rubber solution comprises immersing at least a portion of the sock for 2-5 minutes.

In various embodiments, drying at least a portion of the sock comprises drying at least a portion of the sock in 60-105 degrees Celsius.

In various embodiments, drying at least a portion of the sock comprises drying for 20-25 minutes.

In various embodiments, the immersion time of the sock in the rubber solution corresponds to the thickness of the rubber layer disposed on the sock.

In various embodiments, immersing at least a portion of the sock in the rubber solution produces bubbles on the rubber layer where it is disposed on the toe portion and the heel portion.

In various embodiments, the bubbles disposed on the toe and the heel are configured to provide grip to the sole of the sock when worn.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

BRIEF DESCRIPTION OF THE DRAWINGS

A detailed description of various aspects, features, and embodiments of the subject matter described herein is provided with reference to the accompanying drawings, which are briefly described below. The drawings are illustrative and are not necessarily drawn to scale, with some components and features being exaggerated for clarity. The drawings illustrate various aspects and features of the present subject matter and may illustrate one or more embodiment(s) or example(s) of the present subject matter in whole or in part.

DETAILED DESCRIPTION OF AN EXEMPLARY EMBODIMENT

Figure 1B:
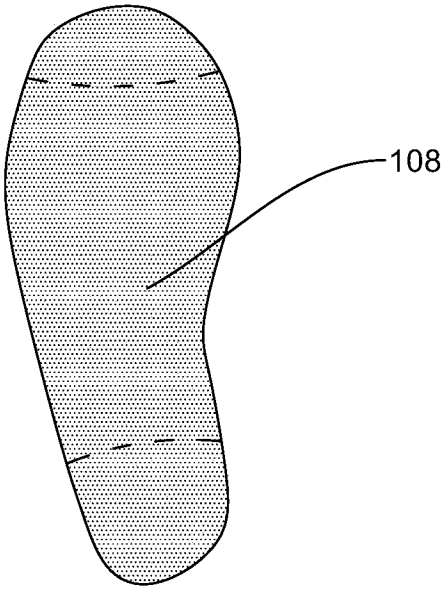
FIG. 1B is a schematic representation of the system for flexible footwear shown in FIG. 1A.

Reference will now be made in detail to exemplary embodiments of the disclosed subject matter, an example of which is illustrated in the accompanying drawings. The method and corresponding steps of the disclosed subject matter will be described in conjunction with the detailed description of the system.

The methods and systems presented herein may be used for flexible footwear. The disclosed subject matter is particularly suited for activities that would benefit from proprioception. For purpose of explanation and illustration, and not limitation, an exemplary embodiment of the system in accordance with the disclosed subject matter is shown in FIG. 1 and is designated generally by reference character 100. Similar reference numerals (differentiated by the leading numeral) may be provided among the various views and Figures presented herein to denote functionally corresponding, but not necessarily identical structures. The methods and systems of the disclosed subject matter, as described above and shown in the drawings, provide for improved proprioception, specifically the sensation that one is engagement with a floor surface when participating in athletics in a plurality of activities.

The invention is an improvement on performance socks whereby the sock is reinforced at the toe and heel and the sock contains a tacky, waterproof substance on the bottom side of the sock and extending up a portion beyond the bottom side of the sock. The thickness of the tacky bottom layer provides for waterproofing the sock but it is still thin enough to feel the surface temperature of the floor below, and thin enough to be able to roll the socks when not in use. The thinness of the layer allows an individual sock to weigh in at about two ounces, which is much lighter than a conventional training shoe.

The invention is also a unique process for applying a tacky substance to the bottom of a sock so that the tacky substance layer is pliable and will stretch to form to the foot, unlike the typical sole of a shoe.

Figure 1A:
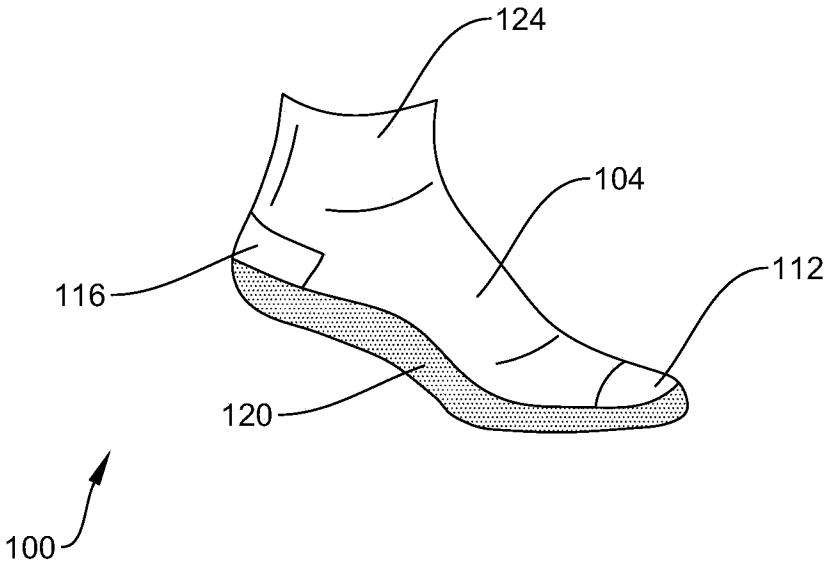
FIG. 1A is a schematic representation of the system for flexible footwear in accordance with the disclosed subject matter.
Figure 1C:
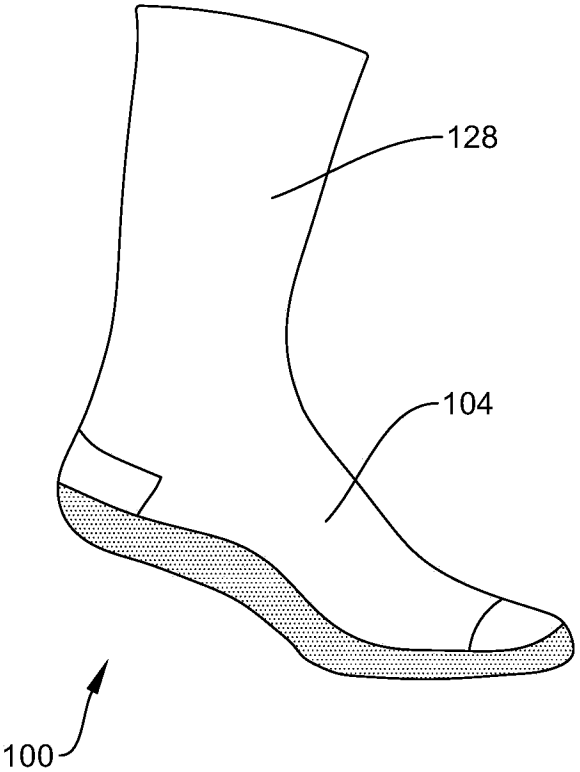
FIG. 1C-D are schematic representations of the system for flexible footwear showing a plurality of leg lengths according to embodiments.
Figure 1D:
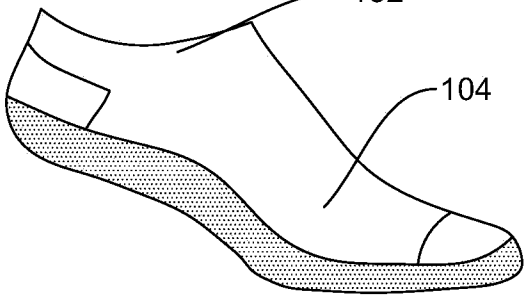

Referring now to FIG. 1A, a footwear article 100 for flexible footwear includes a sock 104. Specifically, and in accordance with the disclosed subject matter, sock 104 embodied herein is a generally tubular, tailored, and shaped garment configured to be slid onto one's foot at a first end that is open at a proximal end through an elongate tubular body until the toes terminate at a second closed end at a distal end. The sock 104 may have a continuous construction, wherein an outer surface has no distinct edges other than the rim of the opening. The sock 104 may have a continuous constructions wherein an inner surface of the sock 104 has no distinct edges other than the rim of the opening. Sock 104 may have an underside configured for contact with the bottom of the human foot. Sock 104 may have an upper side configured to contact the top of the human foot. In various embodiments, sock 104 may have a lateral edge surrounding perimeter of the sock, such that the lateral edge circumscribes the blade of the foot, around the back of the heel, up the instep of the foot and around the front of the toes of the human foot. In the preferred embodiment, sock 104 may include fibrous or fibrous blend materials knit, woven, coupled, or otherwise attached together to form the garment. For example and without limitation, sock 104 may include, in whole or in part, cotton, wool, nylon, acrylic, polyester, olefins (e.g., polypropylene), silk, bamboo, linen, cashmere, mohair, neoprene, modal, viscose rayon, tencel, spandex, or a combination thereof, among others. In general, the material selected for the sock may be quick-drying, moisture wicking, and antimicrobial. The material may be selected such that a user may wear the sock for multiple workouts between washing the sock. Naturally occurring fibrous material and/or synthetic materials may be couple together, woven together, or otherwise combined to create a sock with properties derived from each or the combination of materials. Any of the materials described in this disclosure may be processed before the manufacture of sock 104, such as the process for turning cotton, wool and others into yarn for sock production. Sock 104 may be manufactured in a plurality of processes that are coupled when completed. For example and without limitation, sock 104 may have woven portion and a laminated portion, the two then coupled together to form sock 104, or a portion thereof.

Additionally, or alternatively, sock 104 may include activity-specific characteristics. For example and without limitation, a running-specific sock may have more padding at the ball of foot/toes? For example and without limitation, weightlifting specific socks may have a lift in the heel or more rubber or more grip. For example and without limitation, the sock may include spikes, studs, cleats, or other embossments on the sole to produce a sort of cleated version of the sock. For example and without limitation, the sock may include a more heavy duty sock with structure to use in field sports. The sock may be more covered in the rubber layer to produce a waterproof or semi-waterproof sock for use in water or wet environments.

Sock 104 may include material suitable for impregnation by liquids of a plurality of viscosity. For the purposes of this disclosure, impregnation by liquids is the ability for a material to absorb a liquid throughout its fibers. For example and without limitation, the cotton yarn used to weave sock 104 may be absorbent enough to be impregnated by an oil-based substance, a water-based substance, and any substance with a viscosity generally similar. In embodiments, sock 104 may be configured to absorb liquids with a viscosity similar to resin and/or epoxy. Sock 104 may include materials disposed at one or more locations in its construction based on their inherent qualities. For example and without limitation, sock 104 may include a cotton portion because it is lightweight, and a wool portion, because it is moisture-wicking and heat insulating. Sock 104 may include materials that are mechanically advantageous, such as having high tensile, compressional, or torsional strength and durability. Sock 104 may include materials that are highly thermally insulating or the opposite for cooling the foot inside during activity. Sock 104 may include materials that are waterproof, water resistant or absorbent to varying degree. Sock 104 may be manufactured, processed or otherwise manipulated to allow for the adherence of a waterproof bottom layer onto one or more of its surfaces.

In embodiments, sock 104 may include one or more elastic components in its construction. For the purposes of this disclosure, an elastic component is a material with the ability to stretch and return to its original shape. For example and without limitation, sock 104 may include an elastic component woven within the fibers of the general knit of the sock to create a form-fitting garment. For example and without limitation, sock 104 may include an elastic component around the ball of the foot to secure sock 104 over the toes and another elastic component around the heel and instep of the sock to secure sock 104 around the sides and back of foot. The elastic component may be woven in with other materials that construct sock 104, or adhered or couple to sock 104 as a separate component.

In embodiments, sock 104 may include a leg portion having a plurality of leg lengths. For the purposes of this disclosure, leg portion having a leg length refers to the length of the sock on a human's leg. Referring to FIG. 1A, a mid-ankle leg portion 124 is illustrated. Ankle leg portion 124 may be optimal for heat dissipation and leg mobility. According to FIG. 1C, sock 104 may include a mid-calf leg portion 128. Mid-calf leg portion 128 may be optimal for securing sock 104 on the foot and lower leg during strenuous activity. According to FIG. 1D, sock 104 may include a low-cut leg portion 132. Low-cut leg portion 132 may be optimal for minimal intrusion on a person's movement and be the most like wearing no socks at all. In embodiments, sock 104 may be low cut, no-show, knee high, five-toed (wherein the foot form used below would include a five-toe form accordingly), among others. Each style sock may use the same or similar materials in the construction of sock 104 and the rubber disposed thereon.

With reference to FIG. 1B, a footwear article 100 for flexible footwear includes sole portion 108. Sole portion 108 is generally disposed at the bottom of the sock where the sock makes contact with a walking and/or workout surface. Sole portion 108 may be constructed of the same material as the rest of sock 104, or a separate material or combinations of materials and coupled to sock 104. Sole portion 108 may include reinforced areas where the foot strikes a floor when the sock is worn, for example in the ball of foot and along the outside edge of the foot. Sole portion 108 may include construction suitable for creating a snug fit of sock 104 along the bottom of a foot. For example and without limitation, sole portion 108 may include elasticity patterns that mimic the shape of a foot such as elastic tension around the bottom of the foot behind the ball of the foot, such as to stop the sock from slipping. Sole portion 108 may include padding throughout or in a plurality of areas such as under toes and under the heel.

With continued reference to FIG. 1A, footwear article 100 for flexible footwear includes a toe portion 112. Toe portion 112 may be a reinforced toe. For the purposes of this disclosure, "reinforced" is a characteristic of an area of a garment that has more material, stronger or more durable material, or protection of some kind to reduce the wear on said area of the garment. For example and without limitation, toe portion 112 may have an extra layer of material such as cotton sewn on to the toe box area of the sock to reduce wear in that area and pad the toes. In another example and without limitation, toe portion 112 may include a thicker single layer of material such as cotton to reduce wear and pad the toes. In yet another example, and without limitation, toe portion 112 may include a laminate of different materials coupled together to reduce wear, pad toes, and whatever other beneficial characteristics are associated with those materials, such as waterproofing, moisture wicking, or the like, depending on embodiments.

Toe portion 112 may be disposed on the front-most, closed end of sock 104, where the toes are located on a human foot. Toe portion 112 may be the portion of sock 104 that stretches below the toes. Toe portion 112 may be the portion of sock 104 that extends above, below and around the sides of the toes. Toe portion 112 may be one or more portions of the toe of the sock disposed laterally along the toes, such as the interior portion surrounding the big toe, or the opposite lateral portion, around the pinky toe. Toe portion 112 may include material not conventionally found in sock 104. For example and without limitation, toe portion 112 may include a steel plate disposed between layers of fabric on the upper side of the toe portion 112 configured to deflect heavy objects that may be dropped on the toes during activity, such as weightlifting. One of ordinary skill in the art would appreciate the plurality of protective material that may be disposed on, under, between or otherwise coupled to toe portion 112. These materials may include but are not limited to steel alloys, aluminum, carbon fiber composite, fiberglass, polyvinyl chloride (PVC) acrylonitrile butadiene styrene (ABS), and other plastics, and the like, or a combination thereof.

With continued reference to FIG. 1A, footwear article 100 includes a heel portion 116. Heel portion 116 may be reinforced in the same or similar manner as toe portion 112. For example and without limitation, heel portion 116 may have an extra layer of material such as cotton sewn on, under, over, or around the heel portion of the sock to reduce wear in that area and pad the heel from heel strikes. In another example and without limitation, heel portion 116 may include a thicker single layer of material such as cotton to reduce wear and pad the heel. In yet another example, and without limitation, heel portion 116 may include a laminate of different materials coupled together to reduce wear, pad heel, and whatever other beneficial characteristics are associated with those materials, such as waterproofing, moisture wicking, or the like, depending on embodiments. Heel portion 116 may be generally curved. For example, the heel portion 116 may curve from a first direction to a second direction, wherein the first and second direction are disposed at an angle from one another. In various embodiments, the angle may be 90 degrees. In various embodiments, the angle may less than 90 degrees. In various embodiments, the angle may be 60 degrees or less. In various embodiments, the angle may be greater than 90 degrees. In various embodiments, the angle may be 100-120 degrees. In various embodiments, the heel portion 116 may be substantially linear, such that the sock 104 is generally linear with no substantial curve wherein the heel portion and toe portion are disposed in a straight line with the elongate tubular body disposed therebetween. The heel portion 116 may be disposed on the underside of the sock 104.

Heel portion 116 may include a portion of the sock underneath the heel of the foot, extending up the back of the foot to the Achilles tendon region, and up and around the inside and outside of the heel to create a cup like shape in which the heel may sit. Heel portion 116, in embodiments may refer to only the underside of the heel where the heel contacts the ground. Heel portion 116 may include more reinforcement along the underside and backside of the heel and less reinforcement on the sides of the heel, according to embodiments. For example and without limitation, heel portion 116 may include padding of cotton, wool, plastic synthetics, or the like along the underside and back of heel where the most contact with ground and stretching takes place, respectively and an extra layer of cotton on the sides of the heel, where relatively less stress and strain is placed on those portions. Heel portion 116 may include materials such as plastics, metal, and metal alloys for protection against dropped or rolling objects such as weights used on a barbell. Heel portion 116 may include a thicker cross section than other portions of sock 104 in order to protect against wear and tear and protect the user.

Figure 2:
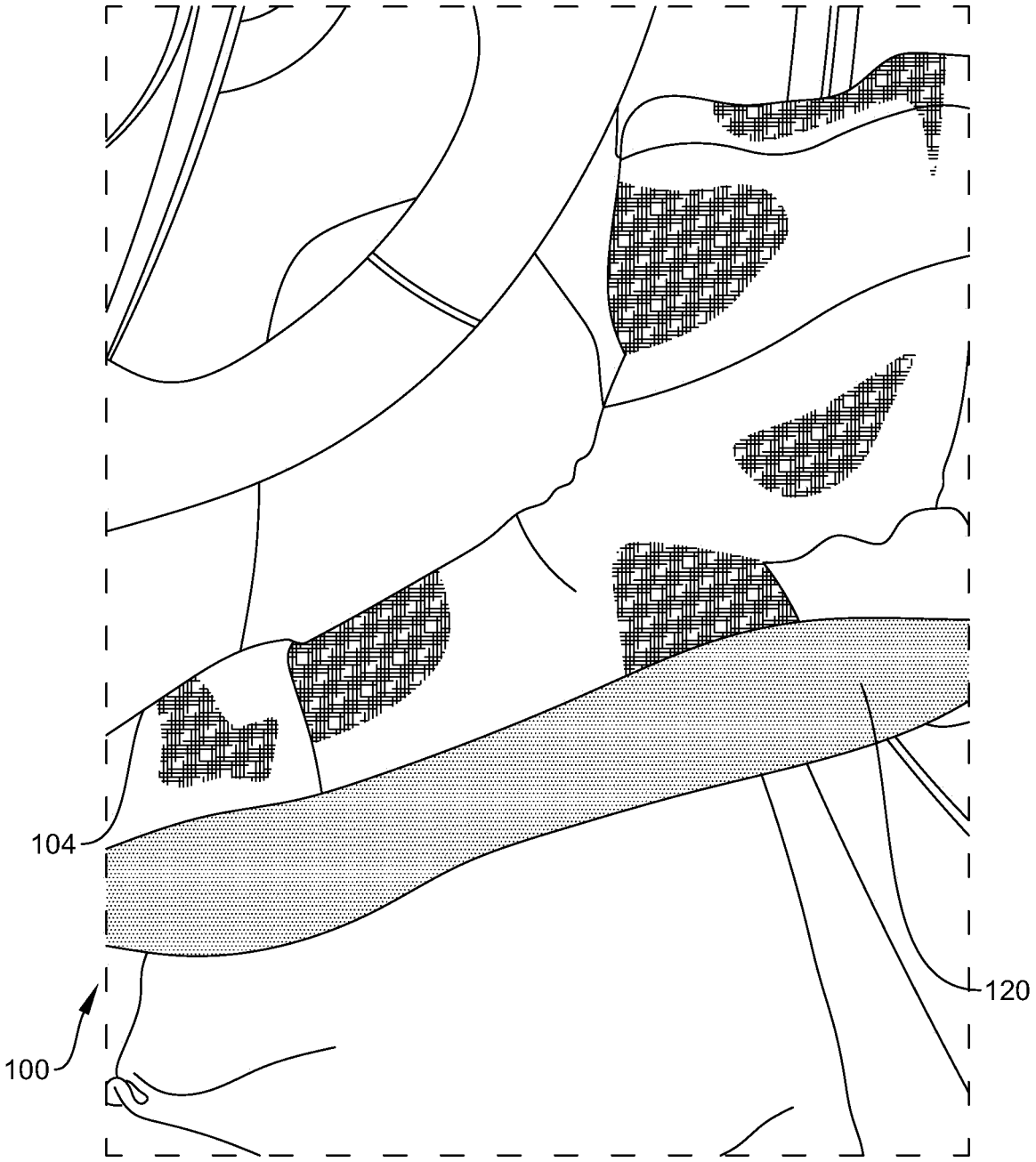
FIG. 2 is a photograph showing a dipped sock with a hardened rubber layer disposed on the underside and around a portion of the sides according to embodiments.

With continued reference to FIG. 1A, footwear article 100 for flexible footwear includes rubber layer 120. Rubber layer 120 is disposed on the underside of sock 104 over sole portion 108. Referring now to FIG. 2, rubber layer 120 may be disposed on a portion of sole portion 108 or the entirety of sole portion 108. As can be seen in FIG. 2, rubber layer 120 covers the bottom of the sock 104, and curls up and around the visible sides of sock 104 like over the toes and heel. Rubber layer 120 may be applied in one layer or a plurality of layers, according to embodiments. Rubber layer 120 may be disposed thicker on one portion of sole portion 108 then another portion of sole portion 108. Rubber layer 120 may be disposed on at least a portion of toe portion 112 and heel portion 116. Rubber layer 120 may be disposed higher on sock 104 than sole portion 108, that is to say that the rubber layer may extend up the sides, back and front of sock 104. Rubber layer 120 may be disposed on toe portion 112 up to a certain point, or extending all the way to the top of toe portion 112. Rubber layer 120 may extend up the back of sock 104 over heel portion 116 entirely, or a portion thereof. For example and without limitation, rubber layer 120 may cover heel portion 116 up until the seam that attaches the heel to sock 104.

Rubber layer 120 may be disposed on a portion of sole portion 108. For example and without limitation, rubber layer 120 may be disposed on the portion of sole portion 108 that mirrors the pattern of the foot inside sock 104. In other words, rubber layer 120 may be disposed on sole portion 108 where the toe pads contact the ground, the ball of the foot, the outer edge of the foot, and the heel. Rubber layer 120 may be disposed in a pattern on sole portion 108 such as ridges, lines, patterns, dots, splatters, and the like.

Figure 3:
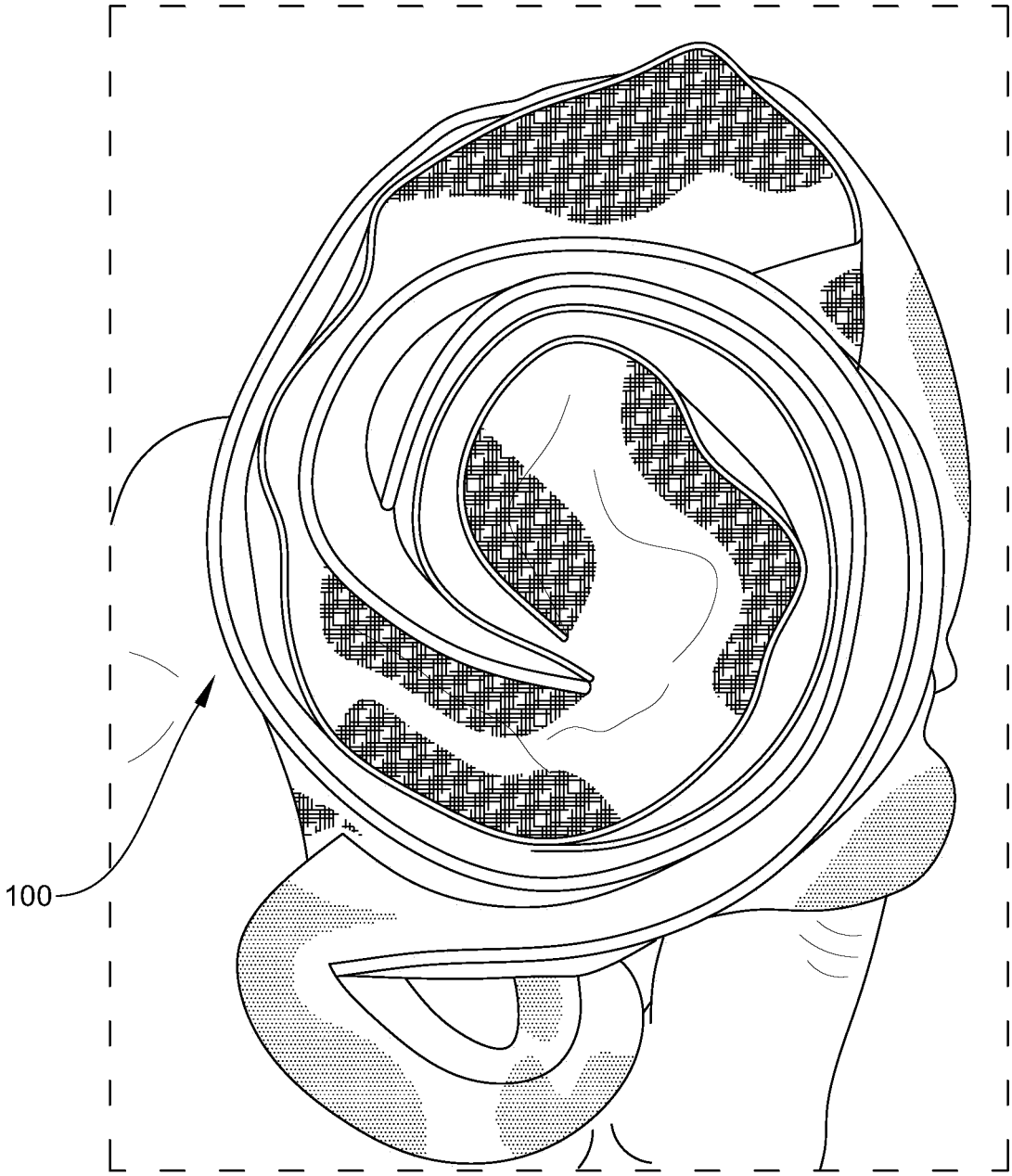
FIG. 3 is a photograph showing a sock with the rubber layer applied according to embodiments rolled up to illustrate the relative thickness of the rubber layer.

Rubber layer 120 may include more than one layer of rubber. For example and without limitation, rubber layer 120 may include layers of different material. Rubber layer 120 may include rubber, nitrile or latex. In one preferred embodiment, the substance used is deproteinized natural rubber. Natural rubber may consist of polymers of the organic compound isoprene. Rubber may also include polyisoprene, elastomers, and the like. Rubber layer 120 may also include synthetic rubbers like polyisoprene, chloroprene, nitrile rubber, silicone, polyisobutilene, hypalon and/or polyethylene. One of ordinary skill in the art would appreciate this is not an exhaustive list of rubbers and their related materials, and these serve only as examples in embodiments. With reference to FIG. 3, sock 104 is rolled to show the relative thickness of rubber layer 120 and the flexibility of footwear article 100. Rubber layer 120 may be a plurality of thicknesses according to area of sole portion 108 it's disposed on, the area of toe portion 112 and heel portion 116 it's disposed on, or another factor. The thickness of rubber layer 120 can be modified by the amount of time sock 104 is dipped into the liquefied substance, which will be discussed at greater length herein below. The dipping process may also be modified to rotate a foot form to cover more area on portions of sock 104. One of ordinary skill in the art would appreciate that rubber layer 120 may refer to more than one layer of the aforementioned materials coupled together and disposed on at least a portion of sole portion 108, toe portion 112 and heel portion 116.

Figure 4:
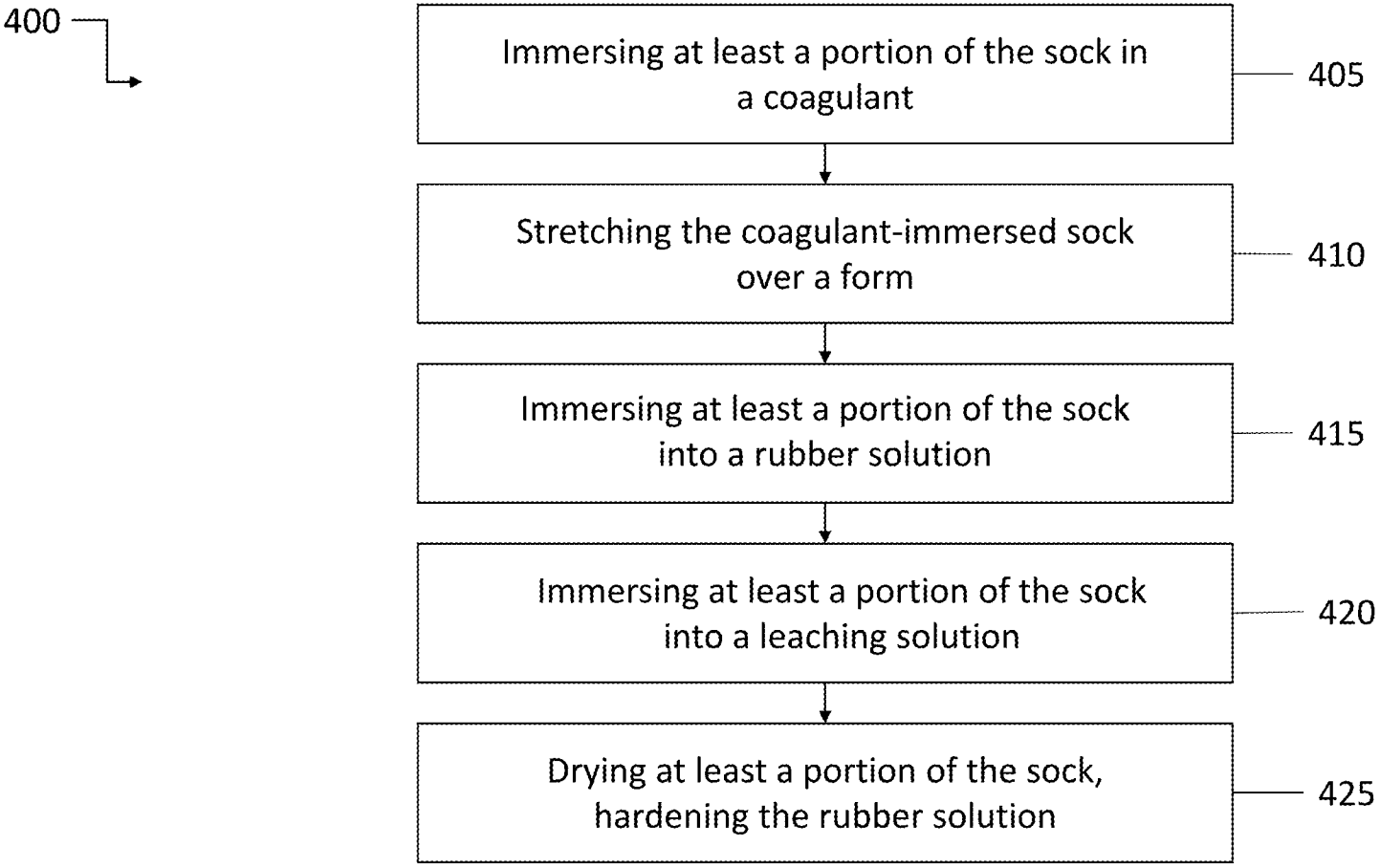
FIG. 4 is a flow diagram of a method for manufacture of a system for flexible footwear according to embodiments.

Referring now to FIG. 4, a method 400 for forming a footwear article, the footwear article being flexible footwear is shown in flow chart form. Method 400, at step 405, includes immersing at least a portion of sock 104 into a coagulant. The coagulant comprises at least one salt, at least a surfactant, at least a thickening agent, and at least a release agent in a water-based solvent. For the purposes of this disclosure, immersing is the act of dipping at least a portion of an object into a container of fluid. For the specific methods put forth here in this paper, the fluid is a liquid at room temperature of a plurality characteristics and makeups. The coagulant comprises at least one salt that is calcium nitrate. Calcium nitrate may be an anhydrous (absorbent) compound. The coagulant may comprise dissolved calcium nitrate in a solution. The coagulant may comprise at least a surfactant configured to lower the surface tension or interfacial tension between two fluids or between a liquid and a solid. A surfactant is also used to wet the dip form (described in further detail below) and assure a smooth even coating. The dynamics of surfactant adsorption is of great importance for practical applications such as in foaming, emulsifying or coating processes, where bubbles or drops are rapidly generated and need to be stabilized. The dynamics of absorption depend on the diffusion coefficient of the surfactant. As the interface is created, the adsorption is limited by the diffusion of the surfactant to the interface. In some cases, there can exist an energetic barrier to adsorption or desorption of the surfactant. If such a barrier limits the adsorption rate, the dynamics are said to be 'kinetically limited'. Such energy barriers can be due to steric or electrostatic repulsions. The surface rheology of surfactant layers, including the elasticity and viscosity of the layer, play an important role in the stability of foams and emulsions.

With continued reference to FIG. 4, the coagulant includes at least a thickening agent. A thickening agent is a substance which can increase the viscosity of a liquid without substantially changing its other properties. A thickening agent may be used to immerse sock 104 so as to thicken the rubber layers in the succeeding steps according to method 400. A thickening agent may also improve the suspension of other components or emulsions which increases the stability of the product. A thickening agent may include starches, polymers, gelling agents, polyurethanes, polyvinyl alcohol (PVA), clays, cellulosics, sulfonates, gums, saccharides, proteins, modified castor oil, organosilicones, a combination thereof, and/or the like.

With continued reference to FIG. 4, method 400, at step 410 includes stretching the coagulant-immersed sock over a form, the form having the shape of at least a portion of a human foot. Sock 104 is taken out of the coagulant, and is now soaked in said coagulant, and stretched over a foot form. The foot form may be a plastic, metal, wood, composite, or otherwise substantially rigid structure coupled to a mandrel. The foot form may be the shape of a human foot of substantially the shape of a human foot. For example and without limitation, for ease of manufacture, the foot form may comprise the approximate shape of a human foot including the relative widths and heights associated with the parts of a foot such as the instep, ball of foot, heel, and toes. The foot form may include one shape for both right and left socks, such that any sock can be worn on any foot because the form used approximated both the left and right foot of a human. The foot form may be configured to stretch the sock to larger than its normal shape, or stretch portions of sock 104 to optimize the dipping process, such as stretching the heel more drastically than normal as to dip more of the heel in said liquid. The foot form may approximate features of a human foot for more accurate stretching and shaping of sock 104. For example and without limitation, the foot form may include sculpted or shaped toes and/or toenails. For example and without limitation, the foot form may include a high arch in the foot and/or flat feet (e.g., low to no arches). Stretching the coagulant-immersed sock 104 over the foot form may include stretching a plurality of socks 104 over a plurality of foot forms at the simultaneously, continuously, automatedly, by hand, or in a combination of methodologies, according to embodiments.

Figure 5:
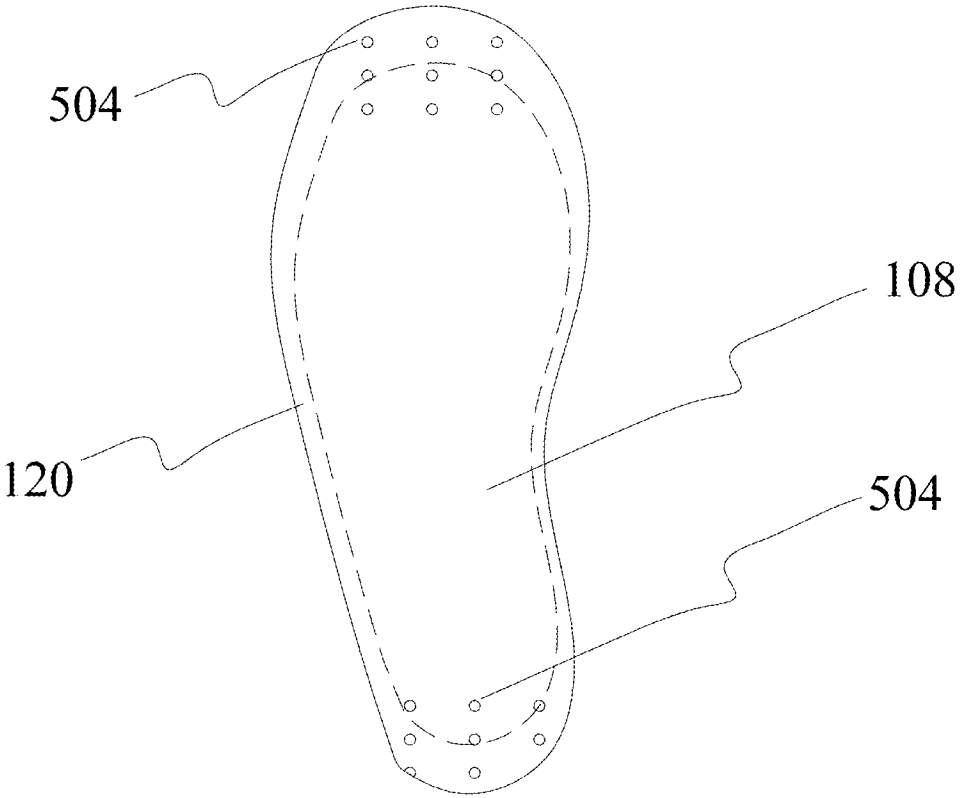
FIG. 5 is a schematic view of the bottom of the system for flexible footwear shown in FIG. 1A-D.
Figure 6:
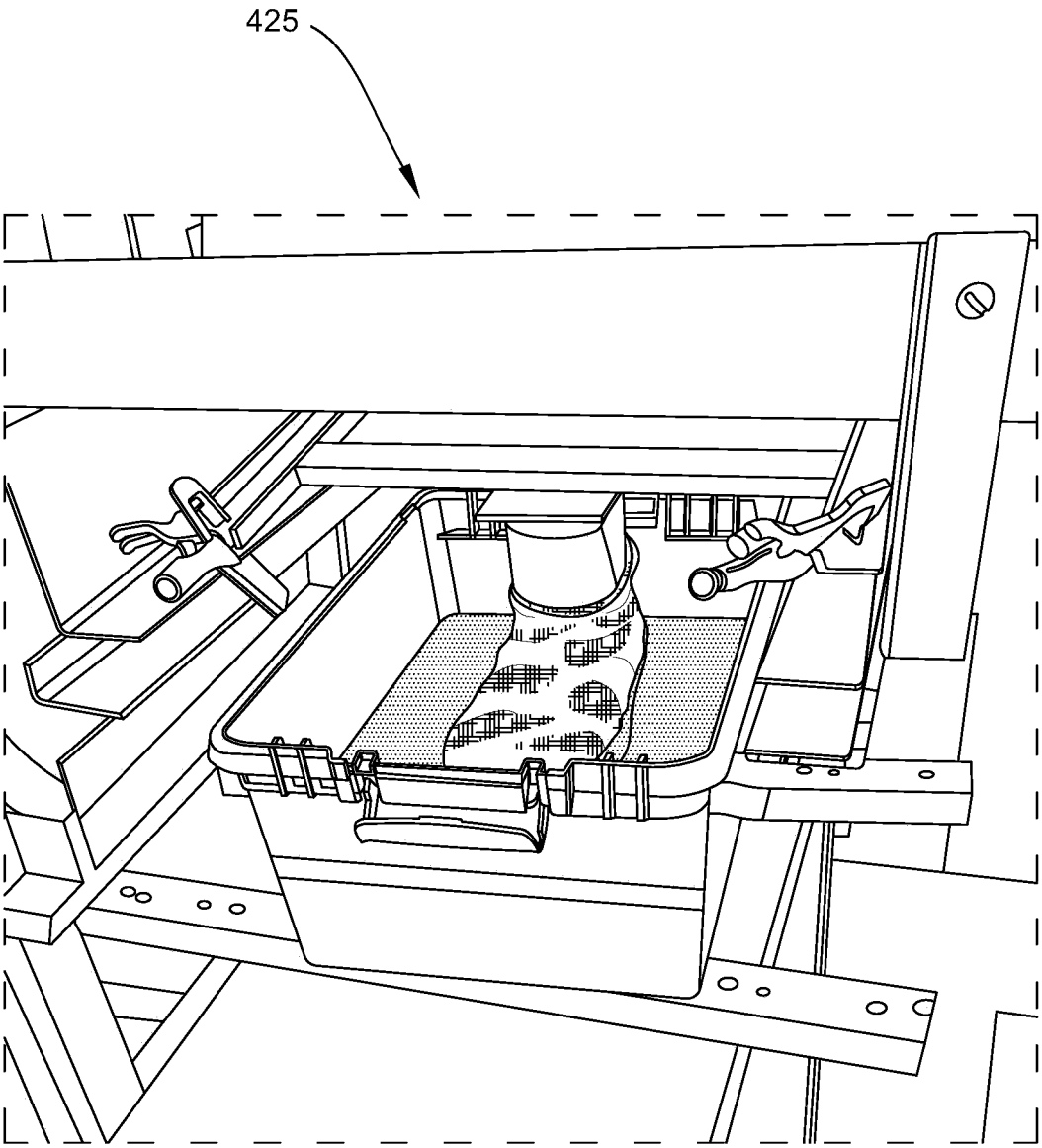
FIG. 6 is a photograph showing the dipping process for the sock in a rubber solution according to embodiments.
Figure 7:
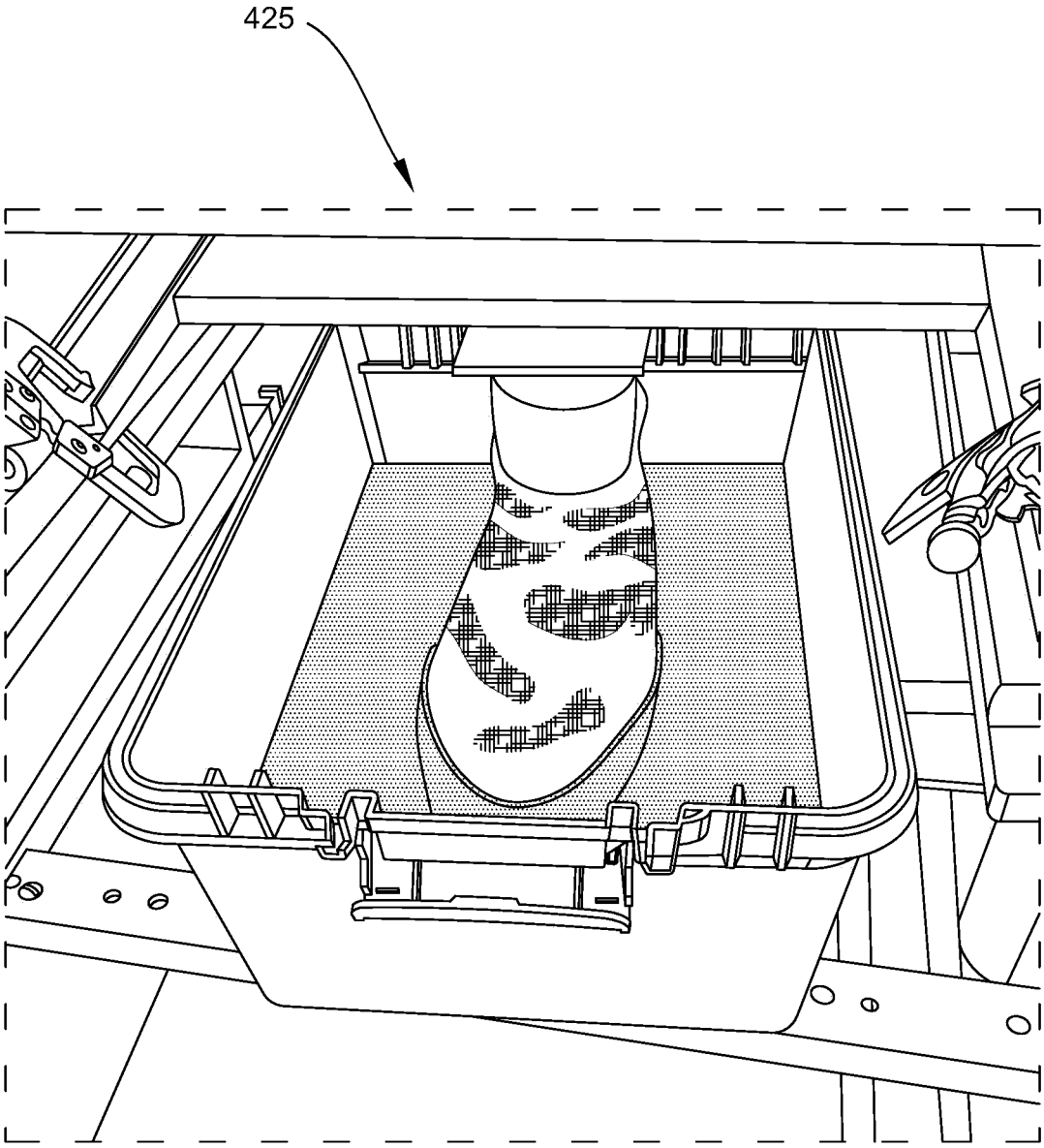
FIG. 7 is a photograph showing another angle of the sock being immersed in the rubber solution.

With continued reference to FIG. 4, method 400, at step 415, includes immersing at least a portion of sock 104 stretched over the foot form into a rubber solution. Immersing at least a portion of sock 104 over the foot form includes dipping at least a portion of sock 104 into the rubber solution. FIGS. 5 and 6 are depictions of sock 104 being dipped into the rubber solution. One of ordinary skill in the art would appreciate this setup and apparatus are only an exemplary embodiment, and does not limit the arrangements of the immersion container and the sock stretched on the form. As stated with reference to footwear article 100, the rubber solution may be rubber, nitrile, latex, a combination thereof, or the like. In various embodiments, the substance used is deproteinized natural rubber. Deproteinized rubber may be used as it is non-allergenic. The non-allergenic rubber may be used because the protein has been stripped out and lessens reaction to the rubber in those allergic. Immersing at least a portion of sock 104 into the rubber solution includes dipping the sock for a period of time. According to embodiments, the dipping in rubber solution may include a plurality of immersion times. For example and without limitation, the thickness of the rubber layer 120 is correlated to a degree to the length in which it was dipped in the rubber solution and let coagulate on sock 104. In various embodiments, the immersion of sock 104 in rubber solution is 2-5 minutes. In various embodiments, the dipping of the sock stretched over the foot form may be rotated a certain degree to cover more of the heel portion in the rubber solution. This corresponds to the amount of rubber layer 120 disposed on heel portion 116. In various embodiments, a first portion of the sock may be immersed in the rubbers solution for a different amount of time than a second portion of the sock. For example and without limitation, the heel portion 116 and the toe portion 112 may be immersed for a longer time than the sole portion extending therebetween. For example and without limitation, the toe portion 112 may be immersed in a rubber solution a shorter amount of time than does the heel portion 116. The most contacted portion of sole portion 108 may be immersed for longer than the least contacted portion of sole portion 108.

When sock 104 is immersed in the rubber solution, the coagulant which has been soaked in by the sock and especially on its surface causes the rubber solution to destabilize and changes states of matter from a liquid to a solid. In embodiments, when the calcium nitrate from the coagulant causes the rubber in the latex to destabilize and turn from a liquid state to a solid state. The change in states of matter may be gradual wherein a portion of sole portion 108's area hardens before another portion, or instantaneously wherein the rubber hardens all at once in an exothermic or endothermic reaction. In embodiments, sock 104 is dipped into the rubber solution in such a way that bubbles are produced on the rubber layer 120 wherein the bubbles are disposed on the underside of the toe portion 112 and heel portion 116. For example and without limitation, the sock 104 may be immersed in the rubber solution with a twisting motion, shaking motion or yawing motion. In various embodiments, sock 104 may be immersed in the rubber solution causing turbulence in the liquid rubber solution, thereby forming bubbles on the rubber solution adhered to the sock 104. FIG. 5 shows bubbles 504 disposed on the front and back portions of the foot, disposed on the underside of toe portion 112 and heel portion 116. Bubbles 504 are configured to provide areas of greater friction and therefore greater grip in the high contact areas of sole portion 108 (e.g., the toes and the heel). The extra grip is beneficial for flexible footwear proprioception and can give the user a more stable footing when utilizing footwear article 100. The rubber layer 120 may be smooth in areas where the bubbles are not located. Bubbles 504 may be disposed throughout rubber layer 120, in patterns disposed along rubber layer 120 such as lines, ridges, dots, the shape of a human foot, or the like.

With continued reference to FIG. 4, at step 420, method 400 includes immersing at least a portion of the sock into a leaching solution. It should be noted that any part of sock 104 that was dipped in coagulant, then dipped in rubber solution, may be dipped in leaching solution. The leaching solution is configured to remove water-based chemicals from the sock. Water-based chemicals like residual salts, surfactants and water-based proteins. The leaching solution may be configured to remove/extract water soluble materials. The leaching solution may be hot regulated water. The leaching solution may remove those and other chemicals present from the process described herein or other chemicals already present in sock 104, as well as dirt and debris lodged in the knit during various immersion steps.

With continued reference to FIG. 4, at step 425, method 400 includes drying the sock. Drying sock 104 activates the hardening process of the rubber solution to form rubber layer 120. Rubber layer 120 hardens in whatever pattern the rubber solution coagulated on sole portion 108 within a certain range. In embodiments, the latex layer may drip, deform, or fall due to gravity during the drying process, and therefore rubber layer 120 may dry in a shape slightly different than the rubber solution. Drying sock 104 may include placing sock 104 in a dryer, the dryer configured to heat the sock in order to harden the rubber solution into rubber layer 120. The dryer may be configured to activate accelerators which, in turn start the curing and/or vulcanization process. The dryer may be an oven with a temperature of around 140 degrees Celsius. The dryer may be configured to circulate one or more fluids such as air through the dryer. The dryer may be configured to dry sock 104 at adjustable temperatures and times according to rubber solution thickness and chemical composition, among other factors. Drying time and temperature can vary to produce specific rubber layer 120 thickness necessary to yield the optimal physical properties and product performance. Drying time to yield optimal physical properties may be 20 to 25 minutes, although one of ordinary skill in the art would appreciate this could differ according to scale of manufacturing process and rubber chemical properties. Drying temperature to yield optimal physical properties may be 60 to 105 degrees Celsius, although one of ordinary skill in the art would appreciate that the temperature range could differ according to manufacturing scale and rubber chemical properties. Cure time may can vary as either the cure time or temperature or both. These methods may vary to produce thinner and thicker coatings depending on use of the sock. For example and without limitation the cure time may be longer and temperature lower to produce a thicker and stiffer rubber layer for outdoor use.

With continued reference to FIG. 4 in various embodiments, method 400 may include washing the sock with the hardened rubber layer. Washing sock 104 with rubber layer 120 disposed on the underside may include using a commercial washing machine with chemical detergent. Washing sock 104 may be done to remove chemicals still in the sock from the various immersion processes, debris, and rubber dispersed within sock 104 various textures. Washing may be performed by a conventional home or commercial washing machine in one or more cycles.

With continued reference to FIG. 4, in various embodiments, method 400 may include drying the sock with the hardened rubber layer after washing. Drying sock 104 at this stage is to remove the moisture absorbed by sock 104's fibers from the washing process. Drying sock 104 may include the same or different dryer then the one or plurality of dryers used in step 425. The dryer utilized to dry the sock may include the same or a different dryer as described previously herein. The dryer utilized in step 425 may include a conventional home dryer or commercial dryer.

While the disclosed subject matter is described herein in terms of certain preferred embodiments, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

What is claimed is:

1. A method for forming a footwear article, the method comprising:

selectively immersing only a sole portion of a sock into a coagulant;

stretching the sock over a form after removing the sock from the coagulant, the form having a shape of at least a portion of a human foot;

immersing the sole portion of the sock into a rubber solution;

immersing the sole portion of the sock into a leaching solution, wherein the leaching solution removes water-based chemicals from the sole portion of the sock; and drying the sole portion of the sock, wherein drying the sole portion of the sock activates a hardening process of the rubber solution thereby forming a rubber layer on the sole portion, and wherein the sole portion of the sock is an underside of the sock extending from a heel portion of the sock to a toe portion of the sock.

2. The method of claim 1, wherein the method further comprises washing and drying the sock and the rubber layer.

3. The method of claim 1, wherein the coagulant comprises at least a salt, at least a surfactant, at least a thickening agent, and at least a release agent in a water-based solvent.

4. The method of claim 3, wherein the salt is calcium nitrate.

5. The method of claim 1, wherein immersing the sole portion of the sock in the rubber solution comprises immersing the sole portion of the sock for 2-5 minutes.

6. The method of claim 1, wherein drying the sole portion of the sock comprises drying the sole portion of the sock at 60-105 degrees Celsius.

7. The method of claim 1, wherein drying the sole portion of the sock comprises drying the sole portion of the sock for 20-25 minutes.

8. The method of claim 1, wherein an immersion time of the sock in the rubber solution corresponds to a thickness of the rubber layer disposed on the sock.

9. The method of claim 1, wherein immersing the sole portion of the sock in the rubber solution produces bubbles on the rubber layer disposed on the toe portion and the heel portion of the sock.

10. The method of claim 9, wherein the bubbles disposed on the toe portion and the heel portion are configured to provide grip to the sole portion of the sock when worn.

* * * * *